US006178978B1

(12) United States Patent
Rieber

(10) Patent No.: US 6,178,978 B1
(45) Date of Patent: Jan. 30, 2001

(54) CHILDREN'S ACTIVITY AND ENTERTAINMENT ENCLOSURE

(75) Inventor: Frederick M. Rieber, Alum Bank, PA (US)

(73) Assignee: Hedstrom Corporation, Bedford, PA (US)

( * ) Notice: Under 35 U.S.C. 154(b), the term of this patent shall be extended for 0 days.

(21) Appl. No.: 09/338,411

(22) Filed: Jun. 22, 1999

(51) Int. Cl.[7] ..... E04H 15/02

(52) U.S. Cl. ..... 135/96; 135/147; 135/152; 472/118; 472/119; 446/227; 297/276

(58) Field of Search ..... 135/121, 124, 135/128, 135, 136, 147, 152, 159, 96; 472/32–35, 118, 119; 446/227; 482/67–69, 143, 43, 51; 297/276–279

(56) References Cited

U.S. PATENT DOCUMENTS

| | | | | |
|---|---|---|---|---|
| 652,872 | * | 7/1900 | Wishart | 472/32 X |
| 1,329,856 | * | 2/1920 | Roman | 472/32 |
| 1,390,502 | * | 9/1921 | Clouser | 297/276 |
| 2,953,145 | * | 9/1960 | Moss et al. | 135/901 X |
| 3,730,587 | * | 5/1973 | Bloxham et al. | 297/274 X |
| 4,084,812 | * | 4/1978 | Melrose et al. | 472/118 |
| 4,627,588 | * | 12/1986 | Block | 446/227 X |
| 4,819,817 | * | 4/1989 | Mar | 211/205 |
| 4,973,044 | * | 11/1990 | Jones | 482/51 |
| 5,884,646 | * | 3/1999 | Ju | 135/124 X |
| 5,930,854 | * | 8/1999 | O'Neill et al. | 135/96 X |

FOREIGN PATENT DOCUMENTS

| | | | | |
|---|---|---|---|---|
| 51505 | * | 4/1936 | (DK) | 135/147 |
| 2136845 | * | 9/1984 | (GB) | 135/135 |

* cited by examiner

*Primary Examiner*—Carl D. Friedman
*Assistant Examiner*—Winnie Yip
(74) *Attorney, Agent, or Firm*—Cesari and McKenna

(57) ABSTRACT

A children's activity and entertainment enclosure includes a housing a plurality of legs attached to the housing to support the housing at a selected elevation above a support surface and a flexible sheet material covering the housing and at least upper portions of the legs. A plurality of activity stations are present within the enclosure as are a seat for seating a child and a suspension mechanism for suspending the seat from the housing so that a child sitting in the seat with feet engaging the support surface can maneuver within the enclosure from one activity station to another.

11 Claims, 5 Drawing Sheets

CHILDREN'S ACTIVITY AND ENTERTAINMENT ENCLOSURE

The present invention relates to a children's toy and more particularly to a play enclosure containing a movable seat for a small child which allows the child to move between a plurality of activity stations within the enclosure.

BACKGROUND OF THE INVENTION

There already exist a various play enclosures for small children. These run the gamut from a tent-like enclosure containing a multiplicity of balls to enclosed children's sandboxes and wading pools. These enclosures invariably have one or more openings to provide access to the enclosure. Thus, a child can enjoy the security of the enclosure without feeling isolated from other people in the vicinity of the enclosure. However, the same openings allow the child to leave the enclosure.

Children's walkers are also commonplace. A child sitting in one of these devices can propel him/herself along the floor in any direction. Therefore, a child using such a walker must be supervised at all times.

Another conventional child's activity toy is a swing, some of which are motorized so that a child can swing back and forth without any outside assistance. While the child on the swing requires minimal supervision, the child may become bored with this repetitive motion, particularly when there are no goals to be reached at the limits of that motion.

Accordingly, it would be desirable to be able to provide a single children's toy which has the advantages of a play enclosure, walker and swing without the aforesaid disadvantages.

SUMMARY OF THE INVENTION

Accordingly, it is an object of the present invention to provide a child's activity and entertainment enclosure which constrains a small child to some extent, yet allows the child to move in three dimensions between a plurality of different activity stations within the enclosure.

Another object of the invention is to provide a children's activity enclosure which allows the child to walk to different activity stations and play with toys there while still maintaining some control over the child's movements.

Yet another object of the invention is to provide a children's activity and entertainment enclosure which can be adjusted to accommodate children of different height.

A further object of the invention is to provide an enclosure such as this which can be stored and shipped in a knock-down condition.

A further object of the invention is to provide an enclosure of this type which can be assembled easily by the purchaser.

A further object of the invention is to provide a children's activity enclosure which is safe to use.

An additional object of the invention is to provide a children's activity and entertainment enclosure which is relatively inexpensive to manufacture in quantity.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the children's activity and entertainment enclosure comprises a relatively large housing which is supported at an elevated position above the floor or ground by a plurality of long legs whose upper ends are rotatably secured to the housing at spaced apart locations around the housing. When the enclosure is in use, the legs extend out from the housing and down to the ground more or less like the legs of a spider. However, the legs can be swung together so that the unit has a relatively small foot print for ease of storage.

Rotatably mounted within the housing is a rotor having a shaft which extends down through an opening in the bottom wall of the housing. That bottom wall and the rotor define a circular track for an array of ball bearings positioned between the rotor and the housing bottom wall so that the rotor can rotate freely relative to the housing about a generally vertical axis. The rotor shaft supports the upper end of an L-shaped rotor arm whose lower end is offset laterally from the rotary axis of the rotor.

Resiliently suspended by way of a spring from the lower end of the rotor arm is an elongated hanger which supports a bag-type seat for containing a small child. As we shall see, the connection between the hanger and the seat allows for vertical as well as angular adjustment of the seat to accommodate different size children. That is, the seat may be adjusted so that a child sitting in a seat can touch the floor with his/her feet so that the child can bounce up and down and walk along the floor. Since the seat is supported by the rotor which is free to revolve within the housing, the child sitting in the seat can follow a more or less circular path within the legs of the enclosure.

Preferably, different toys are attached to the legs of the enclosure. These toys constitute activity stations or destinations to which the child can move by properly manipulating the seat. These stations thus constitute goals for the child which hold his/her interest, encourage mobility and improve the child's limb/eye coordination.

Preferably, the housing and the upper ends of the legs are covered by a canopy which tends to make the space within the legs more cozy without visually isolating the child sitting in the seat. Also, when the toy is placed outside, the canopy protects the child from the sun and sudden rain.

The various parts of the toy are simple metal and molded plastic parts which can be manufactured in quantity at a relatively low cost. Also, the parts are designed so that the entire enclosure can be sold in a knock-down condition so that the product can be shipped and stored in a minimum amount of space. Yet, when it comes time to assemble the enclosure, that can be accomplished relatively easily using only a screwdriver and a small wrench.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF AN ILLUSTRATIVE EMBODIMENT

Figure 1:
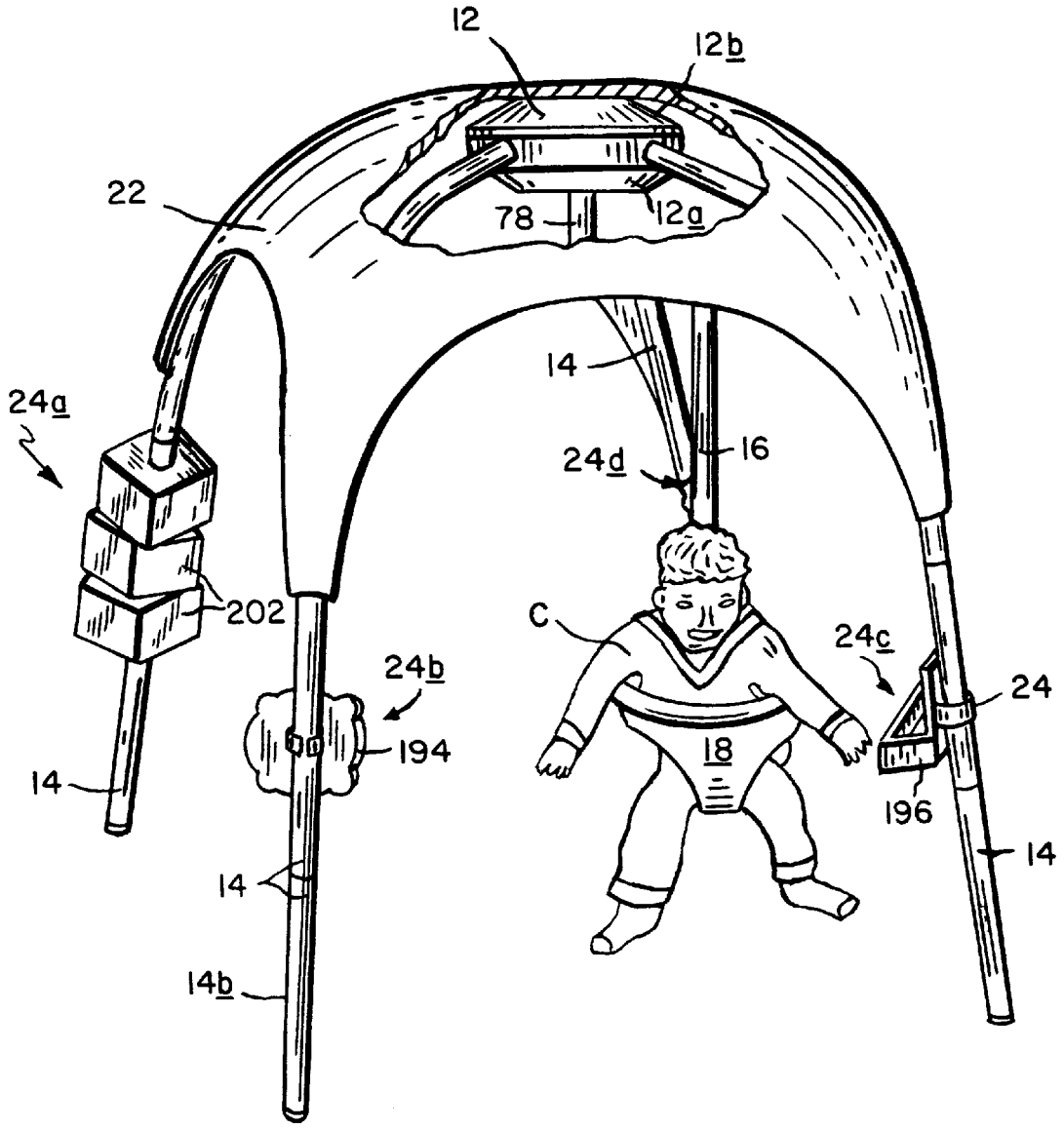
FIG. 1 is a perspective view with parts broken away showing my children's activity and entertainment enclosure.

Referring to FIG. 1 of the drawings, the enclosure comprises a housing 12 supported above the ground or floor by a plurality, herein four, of identical long legs 14. Movably suspended from housing 12 is a vertical hanger 16 which supports a seat 18 for containing a small child C. Preferably, a flexible canopy 22 covers housing 12 and the upper portions of legs 14. The canopy is shaped and designed so as to shield the child C from the elements yet to provide ready access to the interior of the enclosure between the legs 14. As shown in FIG. 1 activity stations 24*a* to 24*d* are located at the different legs 14 at more or less the same elevation as seat 18. These stations can contain various toys. As we shall see, the child C sitting in seat 18, using a combination of leg and arm movements, can manipulate the seat and reach these stations which thus constitute play destinations which will hold the child's interest.

As will be apparent from FIG. 1, the child C is secure within the enclosure and protected from the elements, yet can still be observed by parents. Also, other children are free to walk in and out of the enclosure and interact with child C.

Figure 2:
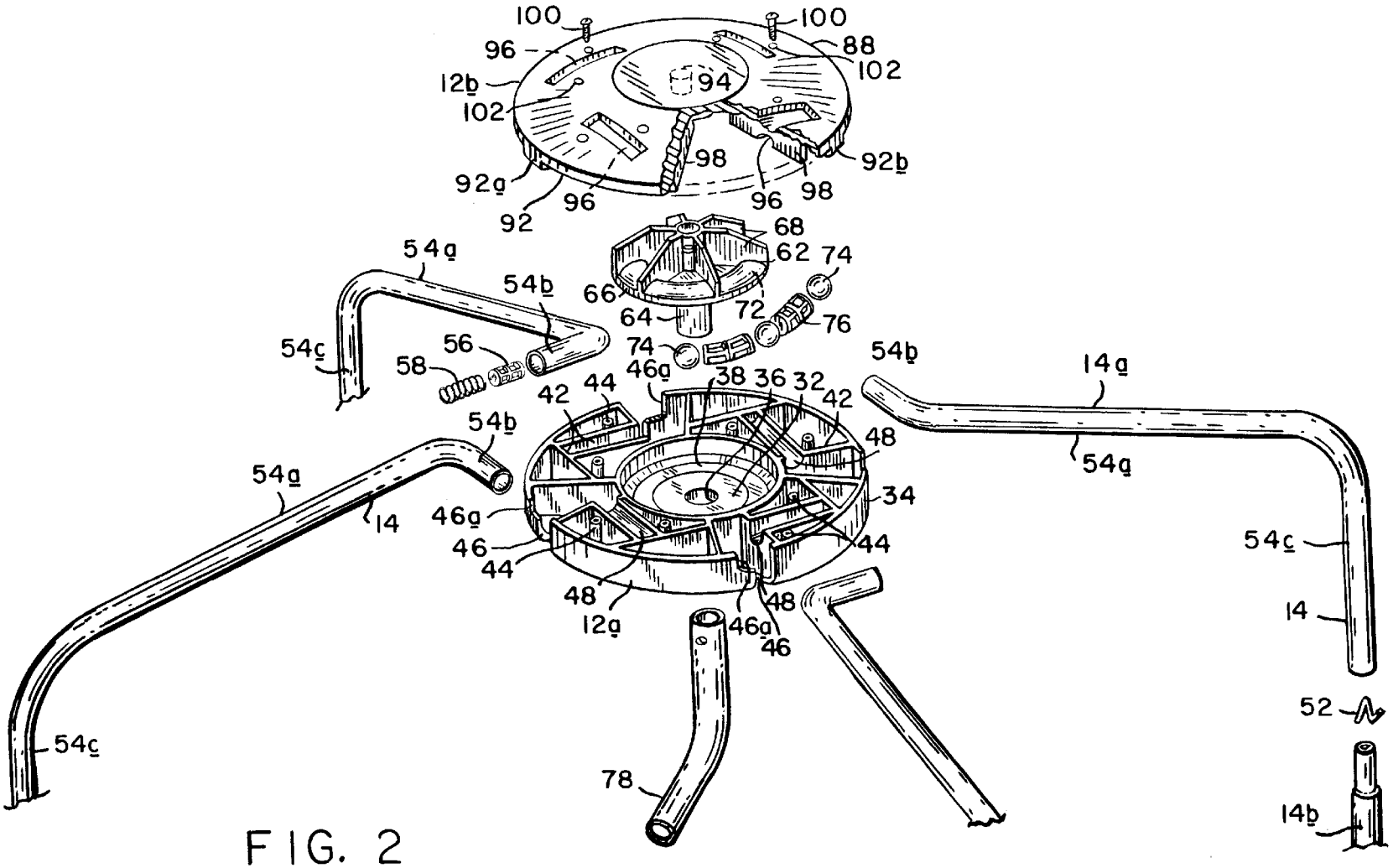
FIG. 2 is an exploded perspective view showing certain parts of the FIG. 1 enclosure in greater detail.
Figure 4:
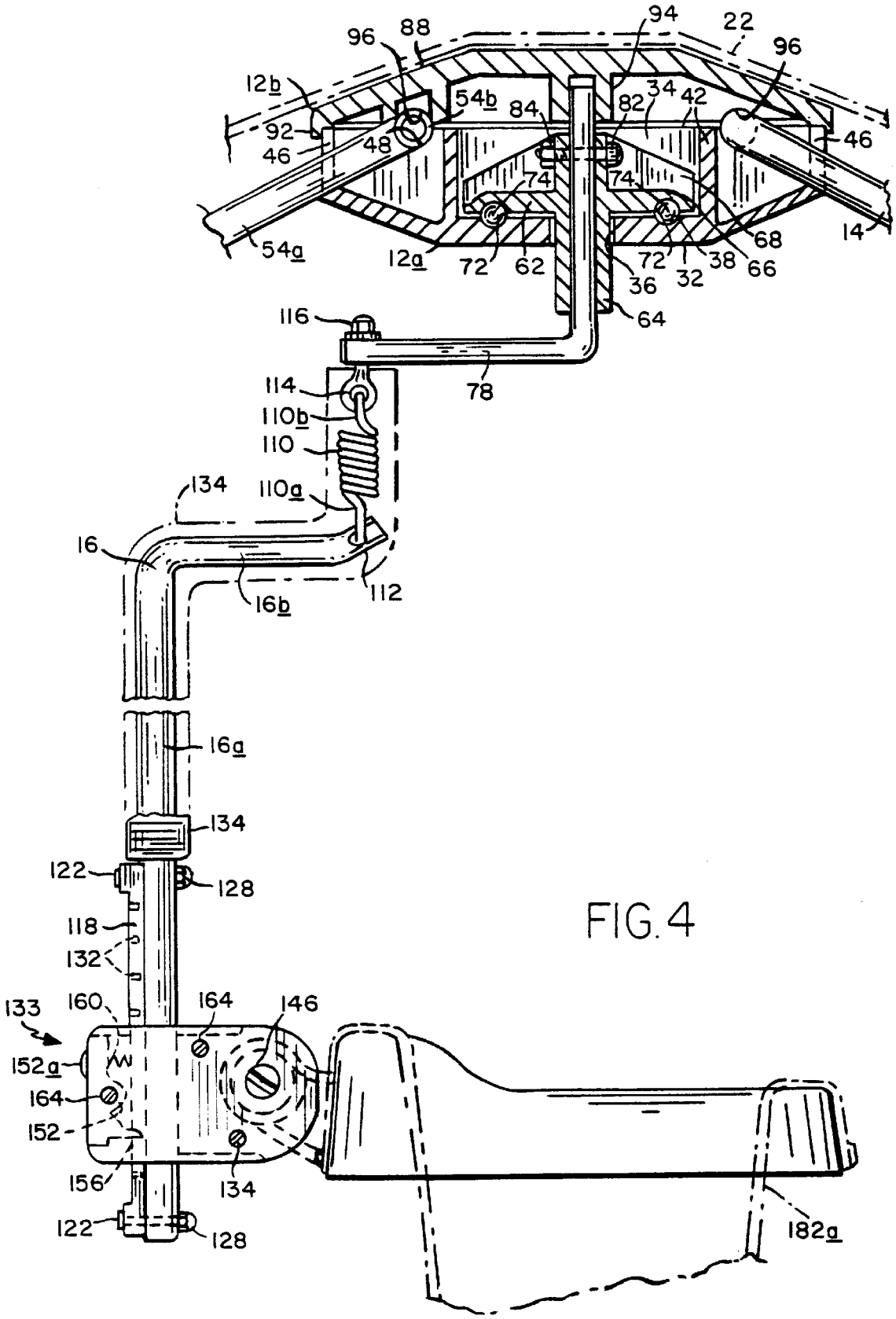
FIG. 4 is a vertical sectional view of the FIG. 1 enclosure with some parts shown in elevation and other parts broken away.

Referring now to FIGS. 2 and 4, housing 12 is comprised of a lower section 12*a* and an upper section or cover 12*b*. Section 12*a* is a molded plastic saucer-like part having a bottom wall 32 and upstanding sidewall 34. Bottom wall 32 has a relatively large central opening 36 and encircling opening 36 is a groove or race 38. The housing section 12*a* is formed with a multiplicity of upstanding intersecting walls 42, many of which extend to sidewall 34 and all serve to rigidify section 12*a*. As shown in FIG. 2, a multiplicity of interiorly threaded screw-posts 44 are formed integrally with walls 42 at distributed locations between race 38 and sidewall 34.

For attaching the legs 14 to the housing, a plurality, herein four, of slots 46 is provided in sidewall 34 and radially outer portions of bottom wall 32. Slots 46 are distributed at equal angles about the circumference of section 12*a*, i.e., a 90° spacing. Also as best seen in FIG. 2, a notch 46*a* is provided in sidewall 34 adjacent each slot 46 for reasons that will become apparent.

As shown in FIG. 2, each slot 46 is bounded by vertical walls 42 and the wall 42 opposite each sidewall notch 46*a* contains the entrance to a leg support channel 48 which extends laterally from each slot 46. In other words, there being four slots 46, there are four leg support channels 48 spaced 90° around the axis of section 12*a*. Furthermore, the channels 48 on opposite sides of section 12*a* are parallel to one another. Thus, there are two pairs of parallel channels 48, the pairs of channels being perpendicular to one another.

Referring to FIG. , each leg 14 comprises a shaped upper section 14*a* and a more or less straight lower section 14*b*. The upper end segment of each section 14*b* has a reduced diameter so that it can be telescoped into the lower end of leg section 14*a* as shown at the right side at FIG. 2. Preferably, a conventional wire leg clip 52 is included at the joint between the two sections to prevent them from coming apart when the enclosure is being moved about.

Each upper leg section 14*a* comprises a relatively long main segment 54*a* and an upper segment 54*b* which is bent laterally at a right angle to segment 54*a*. Each leg section 14 also includes a relatively long lower end segment 54*c* which is bent at a right angle to main segment 54*a* but which also extends more or less perpendicular to segment 54*b*. Each leg section 14*a* is arranged to be attached to housing 12 by inserting the leg section 54*b* through a slot 46 in housing section 12*a* so that the corresponding leg segment 54*b* seats in the leg support channel 48 adjacent to that slot. Preferably, as shown in FIG. 2, the open upper end of each leg segment 54*b* is closed by a plug 56 and a coil compression spring 58 is inserted in each channel 48 between plug 56 and the closed end of the channel. The spring is under compression so that it tends to bias each leg segment 54*b* into the notch 46*a* adjacent to the slot 46 in which that leg section is placed. This helps to minimize unwanted relative movement between housing 12 and legs 14 when the toy is in use.

Still referring to FIGS. 2 and 4, housing 12 is designed to contain a rotor 62 having a tubular shaft 64 which extends down through the opening 36 in the housing bottom section 12*a*. Rotor 62 is formed with a radial flange 66 reinforced with a circular array of strut 68 which extend from the upper end of shaft 64 to the flange. Also, formed in the underside of flange 66 is a circular groove or race 72 which is the mirror-image of race 38 in housing bottom section 12*a*. When rotor 62 is seated in housing section 12*a* as shown in FIG. 4, the two races 38 and 72 form a track for a circular array of ball bearings 74 which separate the rotor from the housing section bottom wall 32. Preferably, the ball bearings 74 are separated by small arcuate plastic spacers 76 (FIG. 2) to minimize the number of ball bearings required to enable rotor 62 to revolve freely within housing section 12*a*.

As best seen in FIG. 4, a generally L-shaped rotor arm 78 is inserted up into the rotor shaft 64 and secured thereto by a bolt 82 which extends through aligned holes in the walls of shaft 64 and arm 78. Bolt 82 is held in place by a nut 84. When so secured, arm 78 can rotate freely relative to housing section 12*a* so that its lower or outer end sweeps out a circle around the axis of housing 12*a*.

As shown in FIG. 4, legs 14 and rotor 62 are positively secured within housing section 12*a* by covering the open top of section 12*a* with the housing upper section 12*b*. Section 12*b* comprises an inverted saucer-shape part having a rounded top wall 88 and a short skirt or sidewall 92. To facilitate centering housing section 12*b* on section 12*a* small tabs 92*a* (FIG. 4) extend from the outer surface of wall 92 so as to engage over the outer edge of housing section 12*a*. A small cylindrical boss 94 extends down from top wall 88. When section 12*b* is seated on section 12*a*, that boss 94 extends into the open upper end of the rotor shaft 64 thereby journalling the upper end of that shaft. The underside of the top wall 88 is formed with semicylindrical leg support channels 96 which are more or less mirror-images of, and complement, the channels 48 in housing section 12*a*. Thus, when the housing section 12*b* is seated on section 12*a*, the various leg upper segments 54*b* are captured between the walls of corresponding channels 48 and 96, but they are still free to rotate within the channels. Also, as with section 12*a*, housing section 12*b* is formed with intersecting vertical walls 98 which help to rigidify that section.

The two housing sections 12*a* and 12*b* are held together by a multiplicity of threaded fasteners 100 which extend down through holes 102 in cover section 12*b* and are screwed into the threaded posts 44 in housing section 12*a*. As seen from FIG. 2, the fasteners are distributed around the housing radially out from rotor 62 and there are fasteners on opposite sides of each channel pair 48, 96 to capture the leg segment 54*b* seated in that channel pair. The leg segments 54*b* can all rotate within their respective channels 48, 96 so that the legs 14 can be swung together when it becomes necessary to store the enclosure in small space.

Figure 3:
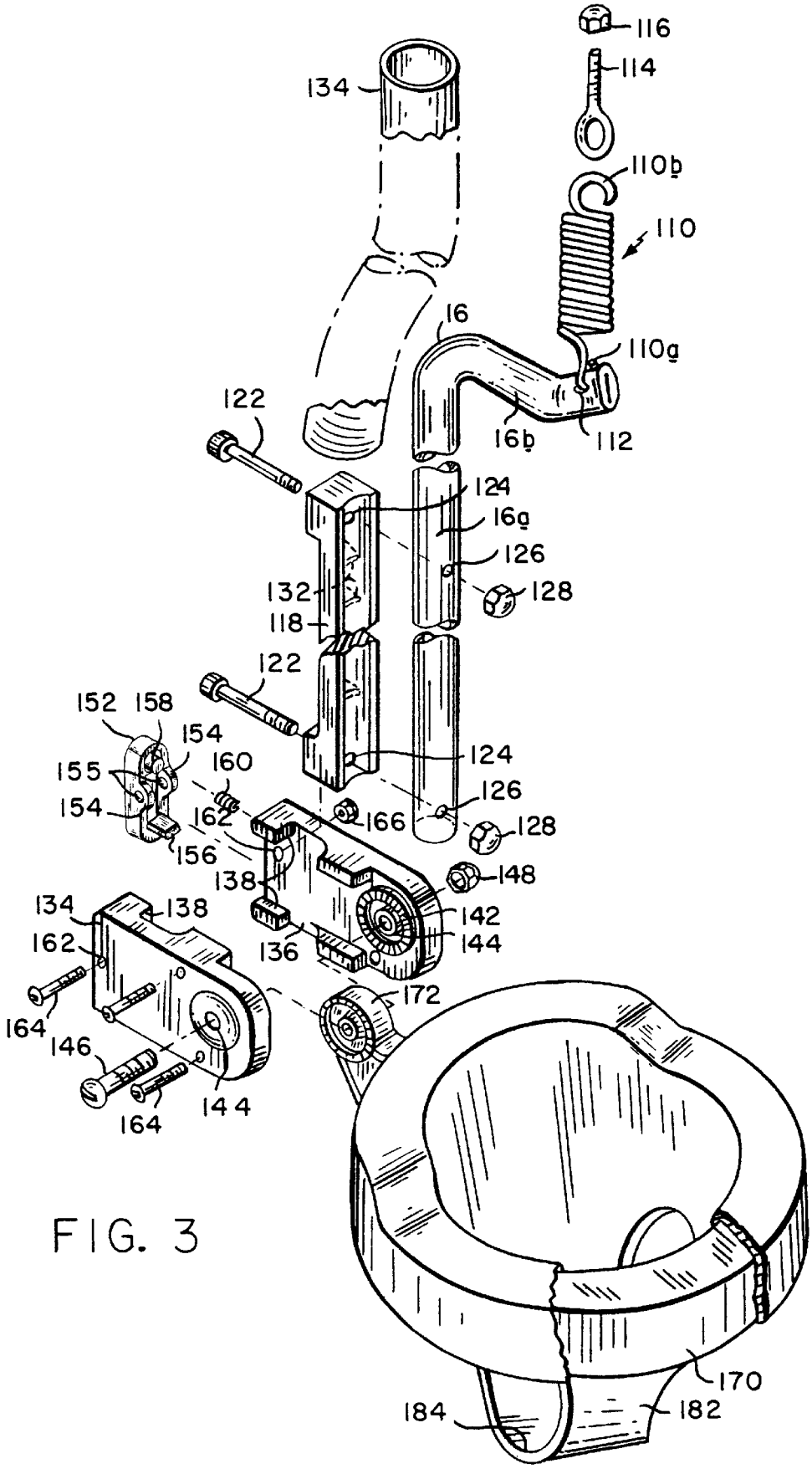
FIG. 3 is a similar view showing other parts of the enclosure.

Refer now to FIGS. 3 and 4 which best illustrate the structure that suspends the hanger 16 and attached seat 18 depicted in FIG. 1 from housing 12. As shown in those figures, hanger 16 has an elongated more or less straight main segment 16*a* and an upper segment 16*b* extending at right angles to segment 16*a*. The flattened upper end of segment 16*b* is slightly upturned and connected to the lower end of a coil spring 110 whose lower end 110*a* is hooked through an eye 112 adjacent the upturned end of segment 16*b*. The upper end 110*b* of spring 110 is hooked to an eye bolt 114 secured to the lower or outer end of the rotor arm 78 by a nut 116 threaded onto the end of the eye bolt.

Figure 5:
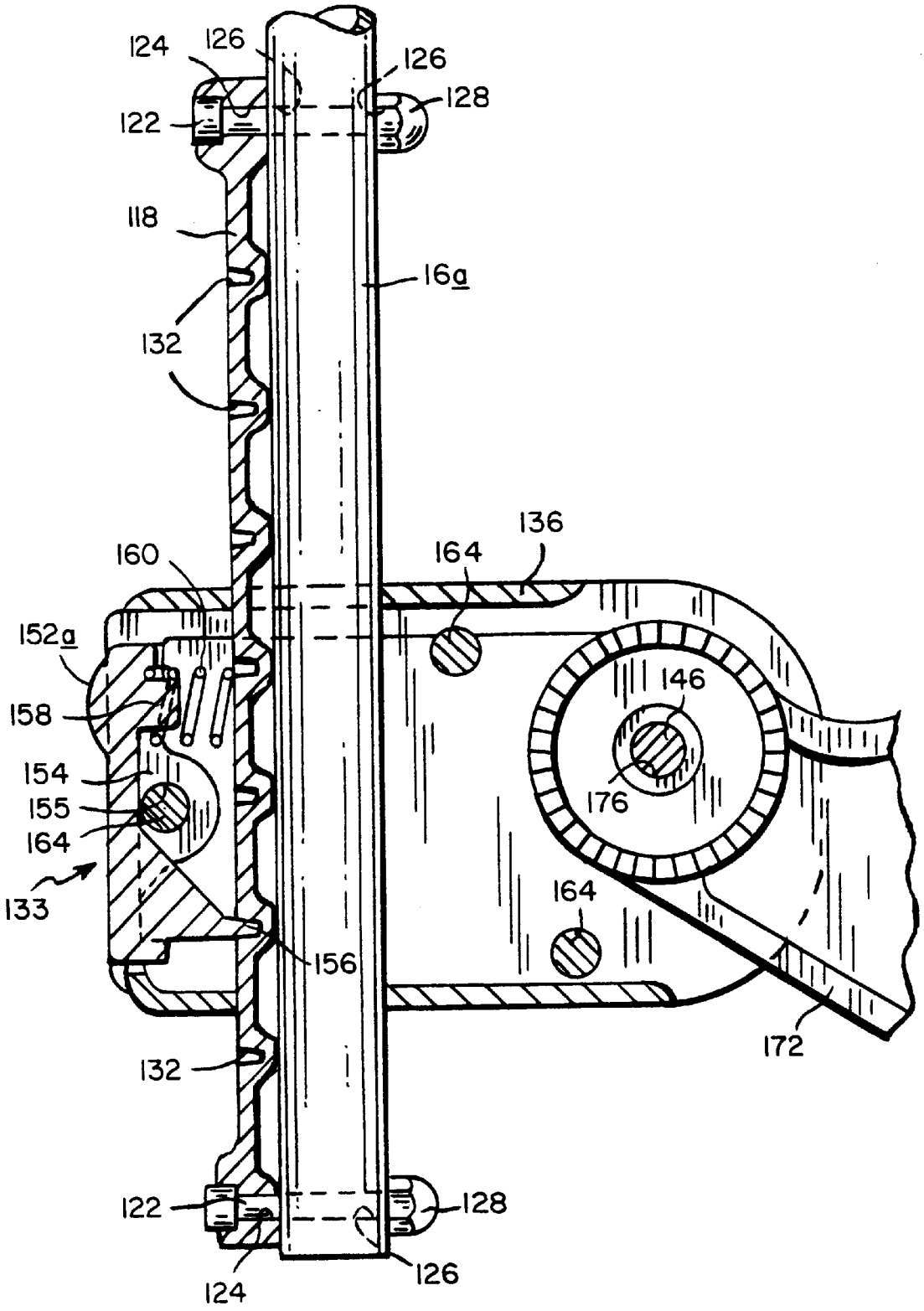
FIG. 5 is a similar view on a much larger scale showing the seat adjustment mechanism of the FIG. 1 enclosure in greater detail.

Mounted to the main section 16*a* of hanger 16 is a rack 118. The rack is secured to the hanger by threaded fasteners 122 which extend through holes 124 in the rack and through aligned holes 126 in the opposite walls of hanger section 16*a*. The fasteners 122 are held in place by nuts 128 screwed onto the ends of fasteners 122 projecting through the hanger section 16*a*. As shown in FIGS. 3 and 5, rack 118 is formed with a vertical series of lateral slots or keepers 132 for reasons to be described later.

Preferably, a pleated flexible tube 134 or a tubular pad is provided to cover eye bolt 114, spring 110 and hanger 16 above rack 118.

Seat 18 is adjustably secured to rack 118 by a bracket assembly shown generally 133 in FIGS. 4 and 5. The bracket assembly 133 comprises a pair of more or less mirror image side plates 134 and 136 which bracket rack 118. Each side plate 134, 136 has upper and lower walls with notches 138 adjacent to one end of the side plate for accepting the adjacent sides of rack 118 and a small sector of hanger 16 so that the two side plates can be brought together from opposite sides of the rack. Also, each side plate 134, 136 is provided with a raised post 142 having an axial holes 144. When the two side plates brought together, the posts 142 and holes 144 therethrough are collinear so the two side plates can be clamped together by a threaded fastener 146 extending through holes 144 and held in place by a nut 148 screwed onto the exposed threaded end of fastener 146.

However, before securing the two side plates 134 and 136 together, an adjustment button or latch 152 is installed between the two side plates opposite rack 118. The adjustment button or latch 152 is basically a rocker arm having a pair of laterally spaced-apart ears 154 extending toward rack 118. Aligned holes 155 are present in those ears. Also a tab 156 extends out from the lower end of button 152 more or less parallel to ears 154 and a lateral boss 158 extends in the same direction from the opposite or upper end of button 152. Preferably, the portion of button 152 opposite boss 158 is raised or rounded as shown at 152*a* in FIGS. 4 and 5.

Before the two side plates 134 and 136 of bracket 133 are clamped together, one end of a coil spring 160 is engaged on the button boss 158 and the button is inserted between the two side plates so that the holes 155 in ears 154 are in alignment with holes 162 formed in the side plates. Then, a threaded fastener 164 is inserted through all of the holes 155 and 162 and held in place but a nut 166 (FIG. 3) threaded onto the exposed end of the fastener 164. Thus, fastener 164 along with fastener 146 securely clamps the two side plates 134 and 136 together on opposite sides of rack 118. Additional fastener 164, nut 166 pairs may be used as shown in FIG. 3 to further strengthen bracket 133. However, the bracket 133 is slidable vertically along the rack 118 to adjust the height of seat 16 above the floor. The bracket is held in various positions of adjustment by the engagement of the button tab 156 in one of the slots or keepers 132 in rack 118. As shown in FIG. 5, the button is biased by spring 160 so that the button tab 156 is urged toward rack 118. Thus, when the bracket is positioned so that the tab is opposite one of the slots 132, the tab will engage in that slot fixing the vertical position of the bracket relative to rack 118. The bracket may be released simply by pushing on the button knob 152*a* which pivots the button in opposition to the bias of spring 160 so that the button tab 156 is withdrawn from slot 132 thereby allowing the bracket to be slid along the rack.

Referring to FIGS. 3–5, the seat 18 comprises a rigid molded plastic support ring 170 having an upwardly-outwardly extending ear 172 which is engaged between the bracket side plates 134 and 136 before those two side plates are secured together as described above. Ear 172 has a lateral passage 176 which may be aligned with passages 144 in the bracket side plates so that when the fastener 146 is inserted through the side plates and secured by nut 148, it automatically pivotally connects the support ring ear 172 to the bracket. Thus, the support ring 170 may be oriented at different angles relative to hanger 16 by loosening fastener 146. Preferably, the opposing surfaces of the side plates and ear are knurled as shown to prevent unwanted pivotal movement of the ring 170 when fastener 146 is tightened.

As shown in FIGS. 3 and 4, the seat support ring 170 supports a more or less conventional flexible bag seat 182 having leg openings 184. The upper edge margin 182*a* of the bag seat 182 extends up within ring 170 and is looped around to the ring and suitably fastened to itself or to the ring by suitable snap fasteners or the like. Thus, the bag seat 182 is firmly secured to ring 170. Yet it can be removed easily when necessary for cleaning, replacement, etc. Preferably, seat 18 includes a seat strap 190 (FIG. 1) attached to the ring 170 to hold the child C in the seat 182.

Activity and entertainment stations 24*a*–24*d* indicated in FIG. 1 may contain any one of a number of toys. In the illustrated embodiment of the invention, the station 24*a* includes a vertical array of different-colored plastic blocks 192 pivotally mounted to leg 14. The blocks have aligned vertical openings so that they can be slid onto leg 14 from the lower end of the leg and supported at a selected elevation on the leg by a pin or collar (not shown) engaged to the leg below the lowest block.

The illustrated activity station 24*b* includes a decorative mirror 194 with a padded frame clipped to leg 14. The activity station 24*c* may be a tray 196 clipped to leg 14 and which may contain a variety of different objects (not shown) to amuse the child C. Station 24*d* may contain another toy.

It will be apparent from the foregoing that a child sitting in the seat 18 may move from one activity station 24*a* to 24*c* to the other by moving the seat along the circular path within legs 14 allowed by the rotation of rotor 62. The connection of the seat 18 to the rotor allows the child to bounce up and down and swivel on spring 110 to achieve motion in three dimensions to optimize the child's enjoyment. Thus the child can proceed from one activity station to another so that the enclosure gives the child a maximum amount of freedom of movement while still confining the child to the enclosure.

It will thus be seen that the object set forth above among those made apparent from the preceding description are officially attained. Also, since certain changes may be made in the above construction without departing from the scope of the invention, it is intended that all matter contained in the above description as shown in the accompanying drawings shall be interpreted as illustrative and not in a limiting sense.

It is also to be understood that the following claims are intended to cover all of the generic and specific features of the invention described herein.

I claim:

1. A children's activity and entertainment enclosure comprising a housing;

a plurality of legs attached to the housing to support the housing at a selected elevation above a support surface;

a flexible sheet material covering the housing and at least upper portions of the legs;

a plurality of different toys attached to the different legs within the enclosure;

seat means for seating a child, and suspension means for suspending the seat means from the housing so that a child sitting in the seat means with feet engaging the support surface can maneuver within the enclosure from one leg to another and touch each toy attached thereto.

2. The enclosure defined in claim 1 wherein each activity station includes a different toy.

3. The enclosure defined in claim 2 wherein the toys are attached to said legs.

4. The enclosure defined in claim 1 wherein the legs are pivotally attached to the housing so that the legs can be swung together.

5. A children's activity and entertainment enclosure comprising a housing;

a plurality of legs attached to the housing to support the housing at a selected elevation above a support surface;

a flexible sheet material covering the housing and at least upper portions of the legs;

a plurality of activity stations within the enclosure;

seat means for seating a child, and suspension means for suspending the seat means from the housing so that a child sitting in the seat means with feet engaging the support surface can maneuver within the enclosure from one activity station to another, said suspension means including a rotor rotatably mounted within the housing for rotation about a generally vertical axis;

a rotor arm attached to the rotor and having a lower end extending below the housing;

an elongated hanger having an upper end attached to the lower end of the rotor arm, and connecting means connecting the seat means to the hanger.

6. The enclosure defined in claim 5 wherein the lower end of the rotor arm is offset laterally from said axis.

7. The enclosure defined in claim 6 wherein the upper end of the hanger is resiliently attached to the lower end of the rotor arm.

8. The enclosure defined in claim 5 wherein the connecting means include a height adjuster for adjusting the distance between the seat means and the upper end of the hanger.

9. The enclosure defined in claim 8 wherein the height adjuster includes a vertical series of keepers on the hanger, and a latching mechanism on the seat means for latching to one or another of the keepers.

10. The enclosure defined in claim 9 wherein the seat means includes a rigid ring and a flexible bag seat suspended from the ring, and the latching mechanism includes a bracket rotatably coupled to the ring and a fastener for fixing the orientation of the ring relative to the bracket.

11. A children's activity and entertainment enclosure comprising a housing;

a plurality of legs attached to the housing to support the housing at a selected elevation above a support surface;

a flexible sheet material covering the housing and at least upper portions of the legs;

a plurality of different toys attached to the different legs within the enclosure;

seat means for seating a child, and suspension means including an extensible hanger for suspending the seat means from the housing so that a child sitting in the seat means with feet engaging the support surface can maneuver within the enclosure from one leg to another and touch each toy attached thereto, and means for adjusting the extension of said hanger.

* * * * *